US008066936B2

(12) United States Patent
Klingensmith et al.

(10) Patent No.: US 8,066,936 B2
(45) Date of Patent: Nov. 29, 2011

(54) COMPLIANT FILL TUBE ASSEMBLY, FILL TUBE THEREFORE AND METHOD OF USE

(75) Inventors: Marshall A. Klingensmith, New Kensington, PA (US); Mark A. Ripepi, Harrison City, PA (US); Rabindra K. Bhattacharyya, Export, PA (US); James T. Burg, Verona, PA (US)

(73) Assignee: Automotive Casting Technology, Inc., Franklin, IN (US)

( * ) Notice: Subject to any disclaimer, the term of this patent is extended or adjusted under 35 U.S.C. 154(b) by 0 days.

(21) Appl. No.: 12/548,413

(22) Filed: Aug. 26, 2009

(65) Prior Publication Data

US 2010/0218910 A1 Sep. 2, 2010

Related U.S. Application Data

(63) Continuation of application No. 12/130,217, filed on May 30, 2008, now Pat. No. 7,601,293, which is a continuation of application No. 10/761,582, filed on Jan. 21, 2004, now Pat. No. 7,407,068.

(51) Int. Cl.
*B22D 41/50* (2006.01)
*B22C 9/08* (2006.01)

(52) U.S. Cl. ..... 266/236; 222/607; 164/335

(58) Field of Classification Search ..... 222/607; 266/236; 164/335
See application file for complete search history.

(56) References Cited

U.S. PATENT DOCUMENTS 6,755,235 B1 * 6/2004 Nedic ..... 164/335
7,407,068 B2 * 8/2008 Klingensmith et al. ..... 222/607
7,601,293 B2 * 10/2009 Klingensmith et al. ..... 266/44

* cited by examiner

*Primary Examiner* — Scott Kastler
(74) *Attorney, Agent, or Firm* — Syndicated Law; Brian S. Boyer

(57) ABSTRACT

A fill tube assembly is for a casting mold. The fill tube assembly includes a fill tube having a tubular member with a receiving end, a mold-engaging end and an intermediate portion. The mold-engaging end has a tapered flange radially extending therefrom, the remainder of the tubular member has a substantially, uniform cross-section. A clamping assembly is structured to maintain a substantially leakproof seal at the fill tube, casting mold interface while accommodating dimensional variations. The clamping assembly includes a gasket, a load ring, a clamping plate and a pre-load gap between the clamping plate and the casting mold and optionally includes a dimensional compensating ring. When tightened, the clamping plate biases the load ring against the flange thereby distributing a uniform load against the casting mold, compressing the gasket therebetween while narrowing the pre-load gap to accommodate dimensional variations. A method of use is also disclosed.

12 Claims, 4 Drawing Sheets

COMPLIANT FILL TUBE ASSEMBLY, FILL TUBE THEREFORE AND METHOD OF USE

CROSS-REFERENCE TO RELATED APPLICATIONS

This application is a continuation of U.S. patent application Ser. No. 12/130,217, filed May 30, 2008, now U.S. Pat. No. 7,601,293, which is a continuation of U.S. patent applicantion Ser. No. 10/761,582, filed Jan. 21, 2004, now U.S. Pat. No. 7,407,068, each of which is hereby incorporated by reference herein in its entirety.

BACKGROUND OF THE INVENTION

1. Field of the Invention

The present invention relates generally to fill tubes for transferring molten metal into a casting mold and, more particularly, to a compliant fill tube assembly that maintains a substantially leak-proof seal between the fill tube and the casting mold while accommodating dimensional variations, due to, for example, thermal changes, tolerance ranges, component degradation and assembly errors. The invention also relates to a fill tube for the foregoing fill tube assembly and to a method of use.

2. Background Information

To avoid commonly known problems associated with casting molten metals by pouring the melt into a mold, for example, by utilizing the assistance of gravity, molten metals, such as molten aluminum, are typically bottom-pressure cast also known as reverse casting or anti-gravity casting. One such casting technique is commonly known in the art as vacuum-riserless, pressure-riserless casting, wherein molten metal travels upward from a melting furnace or bath, through a fill tube and into a mold cavity. At the top of the mold, a vacuum is pulled to evacuate air within the mold. Pressure is then applied to the molten metal in the melting furnace, thereby forcing it up, through the fill tube and into the evacuated mold. After filling the mold, metal in the tube runs back down into the melting furnace, thereby avoiding solidification of metal within the fill tube and problems, such as, contamination and metallurgical defects, associated therewith.

Effective vacuum-riserless, pressure-riserless casting relies on an air-tight seal between the fill tube and the casting mold throughout the duration of the casting process. The fill tube in such casting systems can be made from a variety of materials, such as, for example, titanium and ceramic materials or any other material which will maintain its stability, structure and other properties when in contact with molten metal. It is well known in the art that ceramic materials exhibit good material properties in compression, but respond quite poorly to tensile stresses. Accordingly, there has been a longstanding problem in the art of reverse casting of failing or fracturing fill tubes and the inability to maintain a continuous air-tight seal between the fill tube and the casting mold. Many of these problems are associated with, for example, overtightening the fill tube and thus breaking it while attempting to form a sufficiently tight seal. Another frequent source of fill tube assembly malfunction stems from very tight fill tube assembly tolerances which cannot accommodate dimensional variations or assembly errors. Such dimensional variations can cause uneven loading and sealing problems at the fill tube to casting mold interface, permitting the infiltration of air around the seal into the mold which can result in casting problems such as, for example, fill tube failure, leaking fill tube assemblies, production of scrap castings and downtime of the casting process all of which increase the costs of the cast product.

Dimensional variation may result from, for example: thermal expansion and contraction of fill tube assembly components resulting from temperature variations during the casting process; design or fabrication errors or tolerance variations in the fabricated fill tube assembly components; and fill tube assembly component degradation. Fill tube assembly errors may include, for example: bolt tightening sequencing; overloading of assembly components; and alignment of assembly components.

Known prior art fill tubes and fill tube assemblies typically employ a very rigid, tight tolerance fill tube to casting mold interface and produce unacceptable tensile stress with respect to both the magnitude of stress and the size of area exposed to such stress. Additionally, many known fill tubes and fill tube assemblies require a clamping assembly design that requires very tight tolerance requirements in the production of the fill tube, which increases cost of production. Other known clamping assembly designs have little or no tolerance to assembly errors and employ a fill tube design with significant variations in cross section that can produce undesirable stress risers. See e.g., U.S. Pat. No. 5,919,392 (discussing the shortcomings of several known, patented, fill tubes and fill tube assembly designs). Such fill tube assemblies do not provide any compliance to compensate for or accommodate the foregoing dimensional tolerances of the fabricated components, dimensional changes due to thermal changes over time or assembly errors. Moreover, typical fill tube assemblies are heavy and not installation friendly.

There is, therefore, a need to provide a fill tube, fill tube assembly and method of use thereof that can accommodate dimensional variations occurring during assembly of the fill tube assembly as well as dimensional variations due to thermal changes of the fill tube assembly components occurring during casting operations.

There is a further need for such a fill tube, fill tube assembly and method of use thereof that can provide and maintain a substantially air-tight seal at the fill tube to casting mold interface when employed, for example, in casting operations employing a vacuum, such as, for example, vacuum-riserless or pressure-riserless casting.

There is, therefore, room for improvement in the art of fill tubes, fill tube assemblies and methods of use thereof.

SUMMARY OF THE INVENTION

As one embodiment of the invention, a fill tube for a casting mold comprises: a tubular member having a receiving end, a mold-engaging end and an intermediate portion extending therebetween, the mold-engaging end having a tapered flange radially extending therefrom, the remainder of the tubular member having a generally uniform cross-section.

As another embodiment of the invention, a fill tube assembly for transferring a fluid into a casting mold, comprises: a fill tube and a clamping assembly structured to maintain a substantially leak-proof seal between the fill tube and the casting mold while accommodating dimensional variations.

The fill tube may include a tubular member having a receiving end, a mold-engaging end and an intermediate portion extending therebetween, the mold-engaging end having a flange radially extending therefrom, the remainder of the tubular members having a substantially uniform cross-section.

The clamping assembly may comprise: a gasket disposed between the flange of the fill tube and the casting mold; a load ring disposed over the fill tube and uniformly engaging the flange thereof; a clamping plate disposed over the fill tube onto the load ring, the clamping plate structured to bias the load ring against the flange thereby distributing a uniform compression load against the casting mold and uniformly compressing the gasket therebetween; and a plurality of fasteners structured to fasten the clamping plate to the casting mold.

The clamping plate may include a plurality of fastener-receiving openings corresponding to the fastener-receiving apertures in the casting mold and structured to receive the plurality of fasteners therethrough. Each of the plurality of fasteners may extend through the fastener-receiving openings in the clamping plate into the corresponding fastener-receiving apertures in the casting mold, in order to tighten the clamping plate against the load ring. The clamping plate may be structured to be spaced apart from the casting mold before the plurality of fasteners are tightened, thereby forming a pre-load gap, wherein the pre-load gap is structured to compensate for the dimensional variations. The clamping plate may bend towards the casting mold, narrowing the pre-load gap when the plurality of fasteners are tightened, the tightened clamping plate accommodating the dimensional variations.

The fill tube flange may include a mold-engaging face and a non-engaging face, wherein the non-engaging face of the flange is tapered, wherein the load ring includes a flange-engaging face and a non-engaging face and wherein the flange-engaging face is tapered to correspond with the tapered non-engaging face of the flange. The tapered flange-engaging face of the load ring may be structured to self-center on the tapered non-engaging face of the flange, thereby distributing a uniform compression load on the flange when the clamping plate is tightened.

As another embodiment of the invention, a fill tube assembly is structured to transfer molten metal into a casting mold while accommodating dimensional variations in the assembly, the casting mold including a fill tube socket and a plurality of fastener-receiving apertures. The fill tube assembly comprises: a fill tube having a receiving end, a mold-engaging end and an intermediate portion extending therebetween, the mold-engaging end having a tapered flange radially extending therefrom, the remainder of the fill tube having a substantially uniform cross-section; and a clamping assembly structured to maintain a substantially leak-proof seal between the fill tube and the casting mold, the clamping assembly comprising: a gasket disposed within the fill tube socket between the tapered flange of the fill tube and the casting mold; a load ring, having a taper corresponding to the tapered flange, the load ring disposed over the fill tube and uniformly engaging the tapered flange thereof; a dimensional compensating ring disposed over the fill tube and structured to engage the load ring and to establish and maintain a compressive load between the load ring and the tapered flange while accommodating the dimensional variations; and a clamping plate disposed over the fill tube, the clamping plate including a dimensional compensating ring adjustment mechanism and a plurality of fastener-receiving openings corresponding to the fastener-receiving apertures in the casting mold and structured to receive a plurality of fasteners therethrough, the clamping plate structured to maintain a seal between the tapered flange and the casting mold while further accommodating the additional dimensional variations.

The clamping plate may be structured to be spaced apart from the casting mold, in order to form a pre-load gap sized to compensate for the dimensional variations, the pre-load gap narrowing when the plurality of fasteners are tightened, the tightened clamping plate thereby providing the further accommodation of the additional dimensional variations.

According to an embodiment, the dimensional compensating ring adjustment mechanism may include a threaded aperture in the clamping plate, wherein the dimensional compensating ring is threaded corresponding to the threaded aperture, wherein the dimensional compensating ring is structured for threaded insert into the threaded aperture and wherein the dimensional compensating ring is structured to be rotated to tighten against the load ring in order to establish and maintain the compressive load between the load ring and the tapered flange.

As another embodiment of the invention, a method of transferring molten metal, through a fill tube assembly, into a casting mold, comprises the steps of: providing a casting mold having a fill tube socket and a plurality of fastener-receiving apertures; providing a fill tube assembly including a fill tube with a tapered flange and a clamping assembly structured to maintain a seal between the fill tube and the casting mold while accommodating dimensional variations, the clamping assembly including at least a gasket, a tapered load ring, a clamping plate with a plurality of fastener-receiving openings corresponding with the fastener-receiving apertures of the casting mold, and a plurality of fasteners; inserting the fill tube into the fill tube socket, with the gasket disposed between the fill tube and the casting mold; sliding the tapered load ring over the fill tube to engage the tapered flange thereof; sliding the clamping plate over the fill tube onto the load ring; providing a pre-load gap between the clamping plate and the casting mold, the pre-load gap sized to compensate for the dimensional variations; inserting the plurality of fasteners through the fastener-receiving openings in the clamping plate and into the fastener-receiving apertures in the casting mold, and tightening each of the plurality of fasteners, thereby tightening the clamping plate against the load ring which sealingly compresses the fill tube against the casting mold while narrowing the pre-load gap between the clamping plate and the casting mold, the tightened clamping plate accommodating the dimensional variations.

The method may employ a clamping assembly further including a threaded dimensional compensating ring inserted within a threaded aperture in the clamping plate and structured to provide further accommodations of the dimensional variations.

Accordingly, it is an object of the present invention to provide a fill tube assembly that is tolerant to dimensional changes while maintaining the required load and seal at the fill tube to casting mold interface.

It is another object of the present invention to provide such an assembly that can accommodate dimensional variations due to thermal changes and component degradation.

It is a further object of this invention to provide a fill tube assembly system that will compensate for normal fabrication dimensional tolerance ranges.

It is another object of the present invention to provide a fill tube assembly that is tolerant of assembly errors, such as, for example, bolt tightening sequencing, overloading of assembly components, and alignment of assembly components, which can cause uneven loading and sealing problems at the tube to casting mold interface.

It is yet another object of the present invention to provide a fill tube and fill tube clamping assembly that will hold a fill tube in position with loads that primarily produce compressive stresses with minimal tensile stress.

It is another object of the present invention to provide a fill tube assembly that is lighter weight than existing designs.

It is another object of the present invention to provide a fill tube assembly that is easy to install.

It is a further object of the present invention to provide such a fill tube assembly that is retro-fittable, for use with existing casting molds, while requiring little or no adaptation thereof.

These needs and others are satisfied by the present invention, which provides, among other things, a compliant fill tube assembly, a fill tube therefore and a method of use thereof.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Accordingly, the present invention provides a fill tube assembly and fill tube therefor having a tapered flange at one end and a relatively constant cross section along the remainder of its length and an adjustable clamping assembly adaptable to compensate for departures from manufacturing or fabrication dimensional tolerances; assembly errors, such as, for example, bolt tightening sequencing, overloading of assembly components, and alignment of assembly components; dimensional changes resulting from, for example, thermal changes; and component degradation from, for example, recurrent use.

As employed herein, the term "dimensional variations," refers to changes or misalignment of fill tube assembly components caused by such things as, for example, assembly errors, fabricated component tolerance ranges, thermal expansion and contraction and fill tube assembly component degradation. As discussed herein, variations in each of these dimensional parameters has an effect on the ability to maintain a substantially leak-proof seal at the fill tube to casting mold interface.

Until the compliant fill tube assembly of the present invention was discovered, such dimensional variations resulted in undesirable and costly casting problems, such as, broken fill tubes, scrap castings and extended casting operation downtimes. The fill tube assembly of the present invention can accommodate, among other things, the foregoing dimensional variations while maintaining a sufficient fill tube to casting mold seal.

Figure 1:
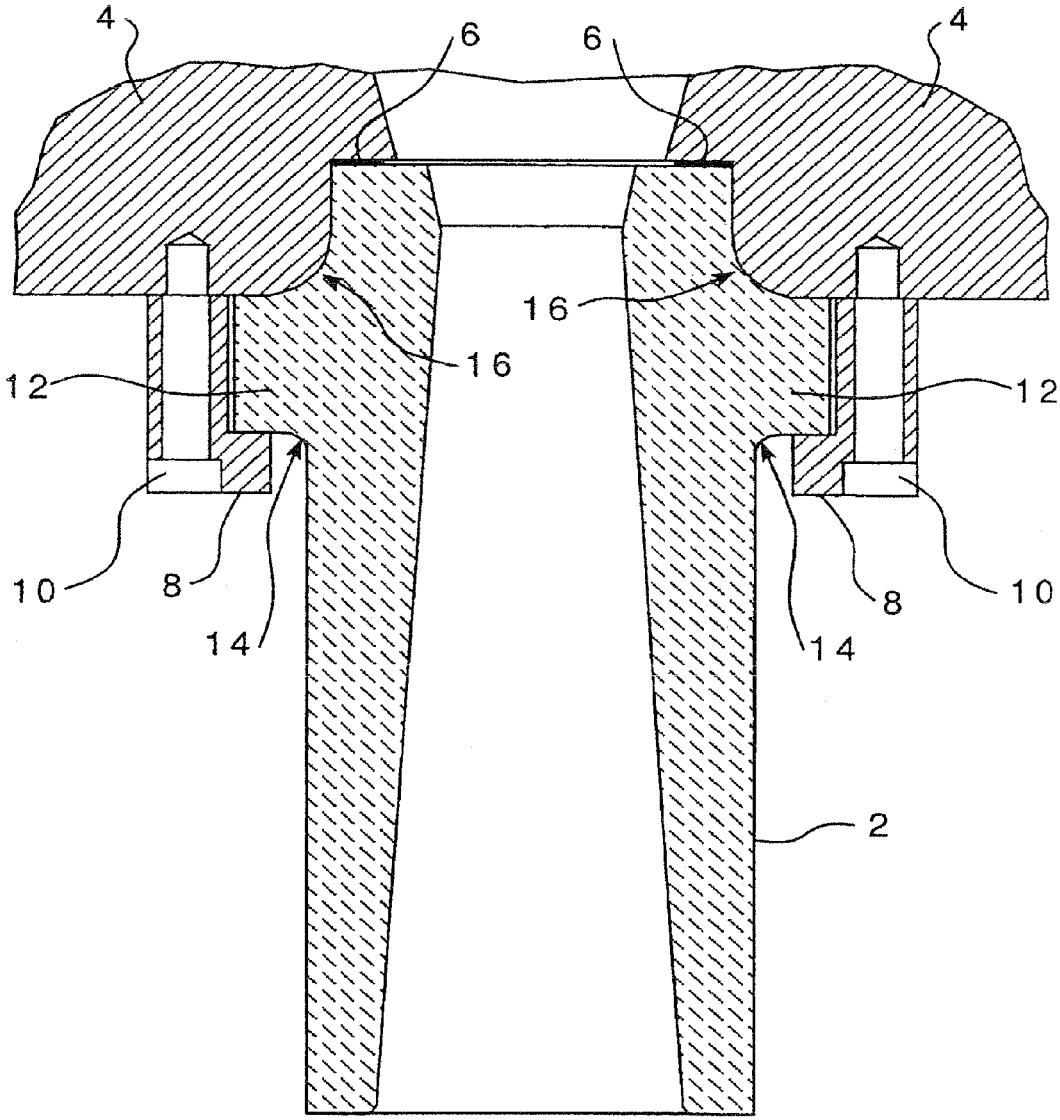
FIG. 1 Prior Art
FIG. 1 is a cross-sectional elevational view of a fill tube assembly.

FIG. 1 illustrates a traditional fill tube assembly for transferring molten metal, such as, for example, molten aluminum, from a melting furnace (not shown) or other source of molten metal, through a fill tube 2 into a casting mold 4. The fill tube assembly shown in FIG. 1, is exemplary of known prior art fill tube assemblies employed for reverse casting operations such as, for example, vacuum-riserless or pressure-riserless casting. However, it will be appreciated that the fill tube, fill tube assembly and method of use thereof, of the present invention can be readily employed in a wide array of casting systems, expressly including, but not limited to, conventional low pressure casting processes not requiring a vacuum. The fill tube 2 is made from a material, such as the exemplary ceramic material, which is substantially impermeable to moisture penetration. It is well known in the casting art that ceramics are capable of withstanding compressive stresses, but react quite poorly to tensile stresses.

Continuing to refer to FIG. 1, the fill tube 2 is attached to the casting mold 4 by an attachment ring 8 tightened using a plurality of fasteners, such as the exemplary threaded bolts 10, shown. A gasket 6 made from any known or suitable material is disposed between the end of the fill tube 2 and the casting mold 4, in an attempt to create an air-tight seal therebetween. As shown, the fill tube 2 has a variable cross-section forming a flange 12. This abrupt variation in cross-section at the formation of the flange 12 with relatively sharp transition corners 14 and 16, creates an undesirable stress-riser in the ceramic fill tube 2. As is well known in the art, such areas of stress concentration are susceptible to failure. For example, the flange 12 is susceptible to failure upon over-tightening of the attachment ring 8. Additionally, as shown, the fill tube assembly has very tight tolerances between components. For example, there is substantially no space between corners 16 of flange 12 and the casting mold 4. Accordingly, the fill tube assembly cannot accommodate or compensate for dimensional variations in, for example, the fill tube 2, the gasket 6 or the casting mold 4. Furthermore, the fill tube assembly cannot accommodate assembly errors, such as, for example, bolt 10 tightening sequence errors or over-tightening. Moreover, the rigid nature of the fill tube assembly and the tight tolerances thereof, cannot accommodate dimensional variations caused, for example, by thermal expansion and contraction. Each of these dimensional variations effect the sufficiency of the load on the seal at the fill tube, casting mold interface. If the seal permits infiltration of air into the casting mold 4, damage to the cast product will likely occur.

Figure 2:
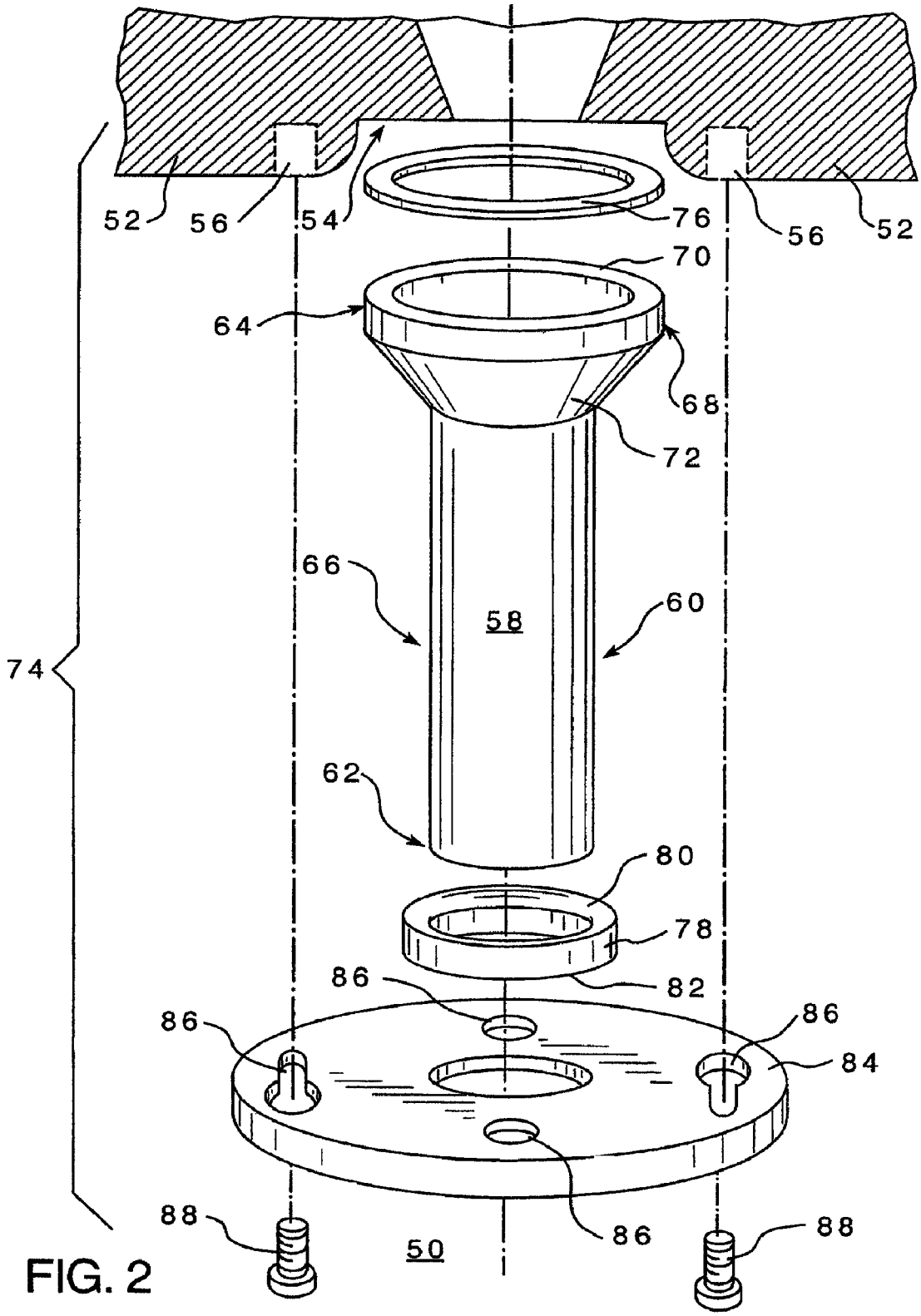
FIG. 2 is an exploded isometric view of a fill tube assembly in accordance with the present invention.

Referring now to FIG. 2, a compliant fill tube assembly 50 in accordance with the present invention, is shown. As shown, the exemplary fill tube assembly 50 includes a fill tube, such as the exemplary ceramic fill tube 58, having a tubular member 60 with a receiving end 62, for receiving molten metal (not shown), a mold engaging end 64 and an intermediate portion 66 extending there between. As shown, the intermediate portion 66 of the exemplary fill tube 58 has a generally annular cross-section in plain view. The mold-engaging end 64 includes a flange 68 radially extending therefrom. The flange 68 includes a mold-engaging face 70 and a non-engaging face 72. The exemplary non-engaging face 72 is tapered, as shown. The tapered non-engaging face 72 provides a gradual transition from the intermediate portion 66 to the flange 68, thus minimizing the creation of undesirable stress-risers occurring in many known prior art fill tubes (see, for example, the abrupt transition of corners 14, 16 of flange 12 in FIG. 1). For example, the taper of the tapered non-engaging face 72 is preferably at an angle of about 15-85 degrees relative to the horizontal plane of the engaging face 70, and more preferably at an angle of about 45 degrees. The remainder of the tubular member 60 has a substantially uniform cross-section.

In addition to reducing undesirable stress concentrations, the exemplary fill tube design 58 is lighter in weight than, for example, the fill tube 2 of FIG. 1, which is representative of known prior art fill tube designs. While the exemplary fill tube 58 is made from ceramic material, it will be appreciated that it could alternatively be made from any material which will maintain its stability, structure and other properties when in contact with molten metal.

Continuing to refer to, the exemplary fill tube assembly 50 further includes a gasket 76 disposed between the mold-engaging face 70 of the fill tube flange 68 and the fill tube socket 54 of the casting mold 52. The gasket 76 is generally annular in shape and may be made from any known or suitable material having durability at high temperatures, such as, for example, above about 800° F. Such materials expressly include, but are not limited to, for example, high-temperature silicon, high-temperature polymers, graphite sheet material commonly known in the art as grafoil, mica and any other known or suitable gasket material.

As shown, a clamping assembly 74 is employed to seal the fill tube 58 against the casting mold 52 while compressing the gasket 76 therebetween, in order to create an air-tight seal. The clamping assembly 74 includes a load ring 78. As shown, the exemplary load ring 78 includes a flange-engaging face 80 and a non-engaging face 82 and has a generally annular cross-section in plain view. The exemplary flange-engaging face 80 is tapered corresponding to the taper of the flange non-engaging face 72. The load ring 78 is disposed over the fill tube 58, in order to uniformly engage the flange 68 thereof (best shown in FIG. 3).

The clamping assembly 74 further includes a clamping plate 84 disposed over the fill tube 58 onto the load ring 78. The clamping plate 84 is structured to bias the load ring 78 against the flange 68, thereby distributing a uniform compression load against the casting mold 52 while uniformly compressing the gasket 76 therebetween. As shown, the exemplary clamping plate 84 has a generally annular cross-section in plain view. The clamping plate 84 includes at least one fastener, such as the exemplary plurality of fasteners 88, structured to fasten the clamping plate 84 to the casting mold 52. As shown, the exemplary clamping plate 84 includes a plurality of fastener-receiving openings 86 (four fastener-receiving openings 86 are shown in FIG. 2), which are structured to receive a plurality of fasteners, such as the exemplary bolts 88, shown, in order to tighten the clamping plate 84 against the casting mold 52. The exemplary fasteners are a plurality of threaded bolts 88 (two threaded bolts 88 are shown in FIG. 2) inserted through the fastener-receiving openings 86 and threaded into the fastener-receiving apertures 56 in the casting mold 52.

Figure 3:
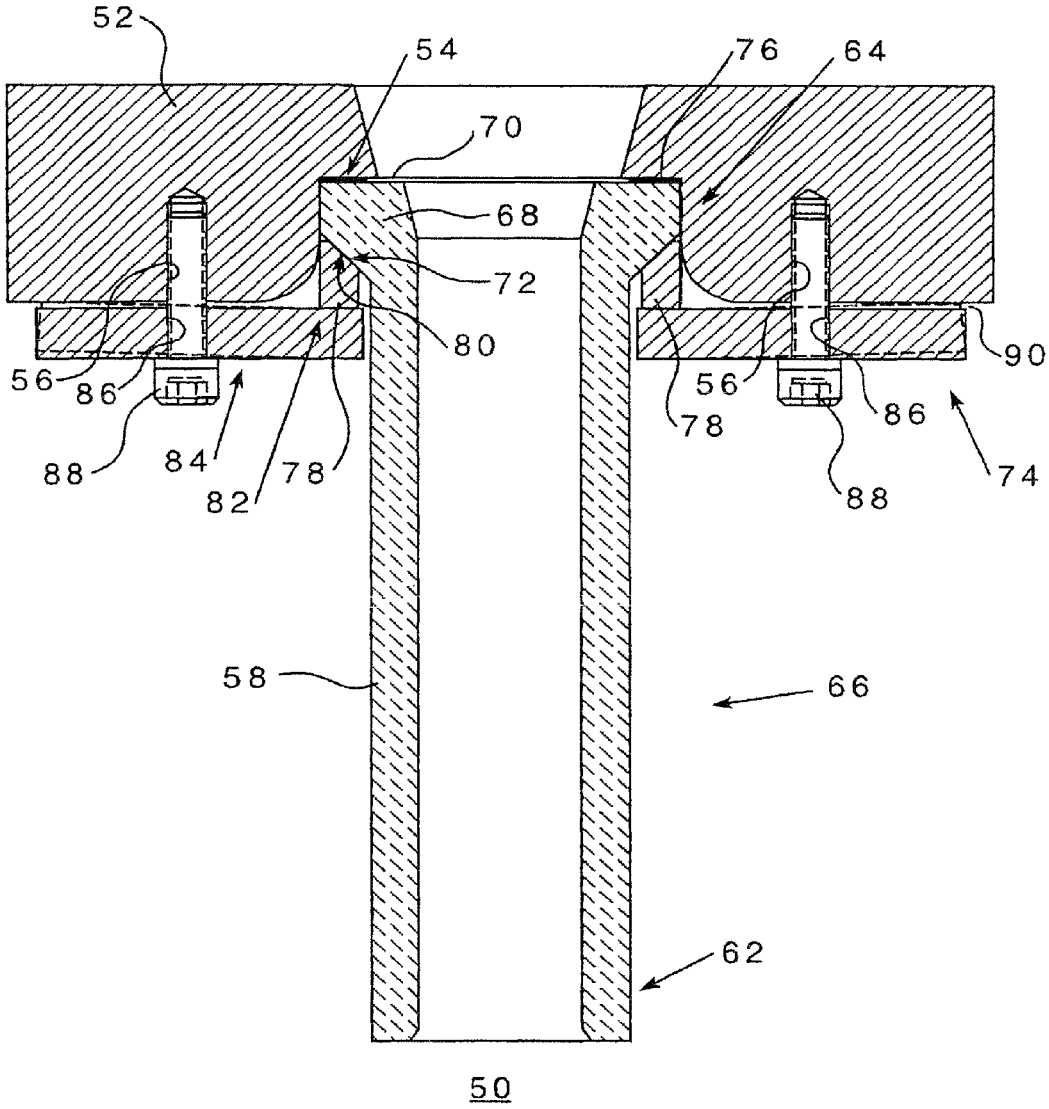
FIG. 3 is a cross-sectional elevational view of the fill tube assembly of FIG. 2 with the clamping plate shown in the tightened position in phantom-line drawing.

As shown in FIG. 3, the exemplary clamping plate 84 is structured to be spaced apart from the casting mold 52 when assembled, in order to form a pre-load gap 90 therebetween. The pre-load gap 90 is structured to compensate or accommodate the forgoing dimensional variations. For example, the pre-load gap 90 is preferably sized to be at least as wide as the aggregate of all of the dimensional variations in the fill tube assembly. More preferably, the pre-load gap 90 is slightly larger than such aggregate to provide additional compensation for any unforeseen, additional dimensional variations, such as, for example, thermal expansion occurring during casting operations. The exemplary pre-load gap 90 permits the clamping assembly 74 to function similar to a spring. For example, when the clamping plate 84 is tightened, it bends toward the casting mold 52 near each tightened, threaded bolt 88 (see, for example, the deflected Belleville washer-shaped clamping plate 84 shown in phantom-line drawing in FIG. 3), thereby narrowing the pre-load gap 90 while applying a constant and uniform compressive load at the fill tube 58, casting mold 52 interface. This uniform load and the somewhat flexible nature of the bent, tightened clamping plate 84, is sufficient to maintain a substantially leak-proof seal at the fill tube 58, casting mold 52 interface, while simultaneously being compliant enough to accommodate dimensional variations in the fill tube assembly 50, such as, for example, thermal expansion, tolerance variations, fabrication defects and assembly errors.

In comparing the exemplary clamping assembly 74 shown in FIG. 3 to the rigid, tight tolerance assembly indicative of the prior art as represented, for example, in FIG. 1, the exemplary fill tube assembly 50 can accommodate such dimensional variations partly because of the exemplary pre-load gap 90 and partly because of the distinct load ring 78 and fill tube flange 68 and clamping plate 84 interaction. As discussed hereinbefore, when tightened, the edges of the exemplary clamping plate 84 deflect or bend, proximate the fasteners 88, thus narrowing the pre-load gap 90 while the central portion of the clamping plate 84 engages the load ring 78, which distributes a resultant uniform compressive load on the fill tube flange 68 and thus the gasket 76, thereby maintaining a fill tube 58, casting mold 52 interface seal while providing compliance with, and the ability to accommodate any dimensional variations in the fill tube assembly 50.

Apart from the foregoing, the particular size of the pre-load gap 90 is not a significant limitation. It will be appreciated that a variety of pre-load gaps (not shown) may be necessary for different casting molds (not shown), in order to maintain uniform pressure at the fill tube casting mold interface while accommodating dimensional variations in accordance with the present invention.

As shown, the exemplary load ring 78 has a tapered flange-engaging face 80 corresponding to the taper of the flange non-engaging face 72. This corresponding tapered relationship permits the exemplary load ring 78 to self-center on the flange 68, thereby ensuring uniform distribution of the compressive load on the flange when the clamping plate 84 is tightened. As discussed hereinbefore, the exemplary tapers of the flange non-engaging face 72 and the flange-engaging face 80 of the load ring 78 are both about 45 degrees. Accordingly, the two tapered surfaces 72,80 will naturally come to rest in a position wherein the exemplary 45-degree tapers will rest fleshly upon one another or "self-center" as shown. However, it will be appreciated that any suitable load ring 78 to flange 68 arrangement (not shown) may alternatively be employed.

Figure 4:
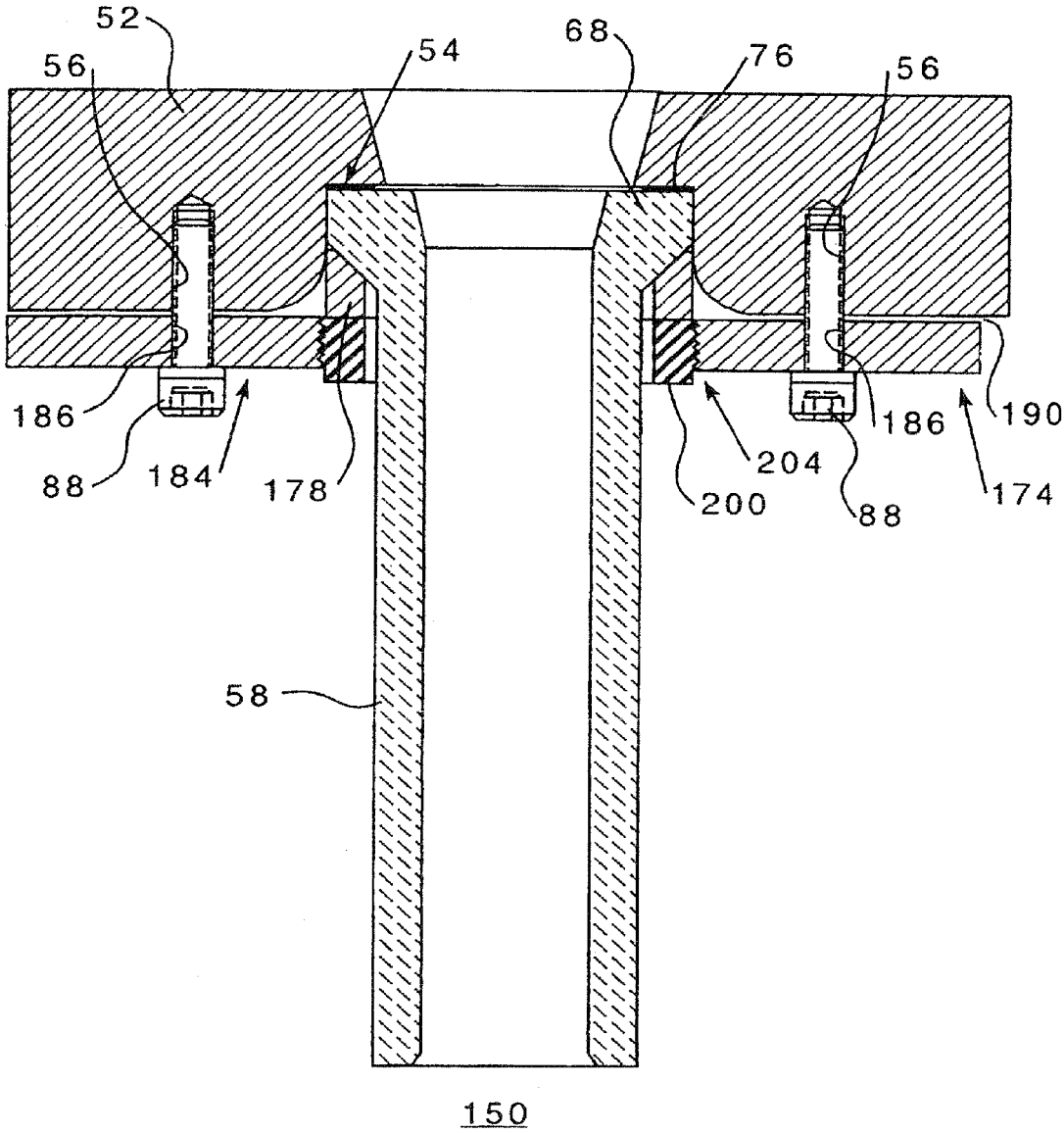
FIG. 4 is a cross-sectional elevational view of a fill tube assembly in accordance with another embodiment of the present invention.

FIG. 4 illustrates an alternative fill tube assembly embodiment 150 similar to the fill tube assembly 50 of FIG. 3, but additionally including a dimensional compensating ring 200. As shown, the same fill tube 58 is inserted against a gasket 76 within the casting mold 52 fill tube socket 54. Additionally, a load ring 178, substantially similar to load ring 78 of fill tube assembly 50 is disposed over the fill tube 58 and uniformly engages the fill tube flange 68. However, the load ring 178 is compressed against the flange 68 by a dimensional compensating ring 200 disposed over the fill tube 58.

In this embodiment, the clamping plate 184 includes a dimensional compensating ring adjustment mechanism, such as the exemplary threaded aperture 204. The exemplary dimensional compensating ring 200 is threaded with threads corresponding to the threads of the threaded aperture 204 in the clamping plate 184. As shown, in use, the exemplary dimensional compensating ring 200 is inserted into the threaded aperture 204 and rotated to tighten against the load ring 178 thereby establishing and maintaining the desired compressive load between the load ring 178 and the exemplary tapered flange 68. In this manner, the exemplary dimensional compensating ring 200 may be assembled to accommodate dimensional variations in, for example, the fill tube 58, casting mold 52, gasket 76 or other fill tube assembly component. For example, as shown, the exemplary dimensional compensating ring 200 is spaced sufficiently far apart from the fill tube 58 to accommodate dimensional variations, while maintaining a uniform compressive load sufficient to maintain the seal at the fill tube 58, casting mold 52 interface. It will be appreciated by those skilled in the art that the particular dimensions of this spaced-apart relationship are not limiting as long as a sufficient seal is maintained while having the ability to accommodate dimensional variations.

Remaining or additional dimensional variations, such as, for example thermal expansion resulting from the introduction of the fill tube assembly 150 to temperatures higher than those at which it was assembled, may be accommodated by the pre-load gap 190 between the clamping plate 184 and the casting mold 52.

Accordingly, the dimensional compensating ring 200 provides additional dimensional variation compliance. For example, a fill tube assembly, for example 150, could be pre-assembled with the dimensional compensating ring 200 screwed down or tightened to a specific predetermined pre-load. Then, the clamping plate 184 and the exemplary pre-load gap 190 between the clamping plate 184 and the casting mold 52 can be adjusted or set to compensate for additional dimensional variations caused by, for example, temperature variations or variations other than those which were accommodated by the dimensional compensating ring 200.

Although it provides additional compliance, it will be appreciated that use of the exemplary dimensional compensating ring 200 is not required. In fact, it has been discovered in the present invention that dimensional variations may be accommodated while maintaining a substantially leak-proof seal at the fill tube casting mold interface, using the exemplary foregoing embodiment of the invention as discussed with reference to FIGS. 2 and 3.

The self-centering load ring 78, fill tube tapered flange 68 and the exemplary clamping plate 84 and pre-load gap 90 provide a low-cost, easily assembled fill tube assembly 50 that is retro-fittable for use with existing casting molds, and which maintains a substantially leak-proof fill tube 58, casting mold 52 interface seal while compensating for or accommodating dimensional variations. Accordingly, the exemplary fill tube assembly 50 greatly reduces the incidence of manufacturing defects caused by the infiltration of air into the casing mold, fill tube failures and extended casting process downtimes, thereby greatly increasing efficiency of the casting process.

It will be appreciated that the fill tube assembly components may be made from a variety of materials. For example, the exemplary load ring 78 is made from 4130 steel. However, it will be appreciated that any known or suitable alternative material could be used. The clamping plate 84,184 may be made from any known or suitable material exhibiting high yield strength at elevated temperatures, such as, for example, above about 800° F. For example, without limitation, the exemplary clamping plate 84,184 is made from Inconel. It will also be appreciated that variations in the arrangement of the fill tube assembly (not shown), such as, the use of spacer ring (not shown) between, for example, the casting mold and fill tube flange or between the load ring and the clamping plate, could be employed.

It will also be appreciated by those skilled in the art that the clamping plate could alternatively have a variable cross-sectional thickness (not shown) and it is not required to be solid. The clamping plate could, for example, include thru slots (not shown). Moreover, the clamping plate need not have a generally annular cross-section. Similarly, alternatives to other components of the fill tube assembly could be developed within the scope of the overall teachings of the present invention.

While specific embodiments of the invention have been described in detail, it will be appreciated by those skilled in the art that various modifications and alternatives to those details, in addition to those discussed above, could be developed in light of the overall teachings of the disclosure. Accordingly, the particular arrangements disclosed are meant to be illustrative only, and not limiting as to the scope of the invention, which is to be given the full breadth of the claims appended and any and all equivalents thereof.

We claim:

1. A compliant fill-tube joint for a casting process, wherein the joint comprises:

a fill-tube flange releasably connected to an inlet port of a casting mold using a non-rigid, pre-loaded clamping mechanism, wherein the fill-tube flange composes a portion of a fill tube for transferring a molten metal to the casting mold; wherein, the fill-tube flange has (i) an engaging surface that mates with the inlet port of the casting mold and (ii) a tapered non-engaging surface that contacts the pre-loaded clamping mechanism, wherein the engaging surface is adapted to provide a substantially leak-proof connection with the inlet port of the casting mold when pressure is applied to the non-engaging surface from the pre-loaded clamping mechanism;

the tapered non-engaging surface functions to minimize stress concentrations;

the pre-loaded clamping mechanism includes a pre-load gap that (i) facilitates a compensation and adjustment of pressure and (ii) maintains the substantially leak-proof connection despite a dimensional variation in the fill-tube joint; and, the pre-load gap facilitates application of a substantially uniform compressive load against the flange irrespective of the temperature of the clamping assembly.

2. The joint of claim 1, wherein the fill-tube flange, the casting mold, and the clamping mechanism are configured for assembly in a bottom pressure, reverse casting process.

3. The joint of claim 1, wherein the tapered non-engaging surface is tapered in an amount ranging from about 15 degrees to about 85 degrees from the engaging surface.

4. The joint of claim 1, wherein the tapered non-engaging surface is tapered in an amount of about 45 degrees from the engaging surface.

5. The joint of claim 1, wherein the substantially leak-proof connection is an airtight connection.

6. An adjustable and compensating fill-tube assembly, comprising:

a fill-tube comprising a tubular member having a flange end and an end for receiving a molten metal composition, wherein the flange end has an engaging surface for releasably connecting with the inlet port of the casting mold and a non-engaging surface for contacting and receiving a pressure that creates a substantially leak-proof connection between the engaging surface and the inlet port;

a casting mold having an inlet port for receiving the flange end of the fill-tube; and, a pre-loaded clamping member that contacts the non-engaging surface and fastens to the casting mold to form a non-rigid connection with the casting mold, wherein the non-rigid connection comprises a pre-load gap that functions to compensate for a dimensional variation during assembly and operation of the fill-tube assembly; wherein, the pre-load gap facilitates application of a substantially uniform compressive load against the flange irrespective of the temperature of the clamping assembly.

7. The fill-tube assembly of claim 6, wherein the non-engaging surface is tapered and functions to minimize stress concentrations on the fill-tube during assembly and operation of the fill-tube assembly.

8. The fill-tube assembly of claim 6, wherein the fill-tube flange, the casting mold, and the clamping mechanism are configured for assembly in a bottom pressure, reverse-casting process.

9. The fill-tube assembly of claim 6, wherein the tapered non-engaging surface is tapered in an amount ranging from about 15 degrees to about 85 degrees from the engaging surface to minimize stress concentrations.

10. The fill-tube assembly of claim 6, wherein the tapered non-engaging surface is tapered in an amount of about 45 degrees from the engaging surface.

11. The fill-tube joint of claim 1, further comprising a gasket material positioned between the engaging surface of the fill-tube flange and the inlet port of the casting mold, the gasket material comprising a component selected from the group consisting of a high-temperature silicon, a high-temperature polymer, and a graphite sheet material.

12. The fill-tube assembly of claim 6, further comprising a gasket material positioned between the engaging surface of the fill-tube flange and the inlet port of the casting mold, the gasket material comprising a component selected from the group consisting of a high-temperature silicon, a high-temperature polymer, and a graphite sheet material.

* * * * *